US005839386A

United States Patent [19]

Frieling et al.

[11] Patent Number: 5,839,386

[45] Date of Patent: Nov. 24, 1998

[54] VEHICLE STABILIZING BY ROTATING MASS

[75] Inventors: Edward Frieling, 5670 Willow Creek Ct., Delray Beach, Fla. 33484; Steven Karney, Parkland, Fla.

[73] Assignee: Edward Frieling, Delray Beach, Fla.

[21] Appl. No.: 646,849

[22] Filed: May 8, 1996

[51] Int. Cl.[6] ..... B63B 9/08

[52] U.S. Cl. ..... 114/121; 74/5.22; 74/5.44; 114/283

[58] Field of Search ..... 74/5.12, 5.22, 74/5.44, 5.8; 114/121, 122, 126, 283, 285, 162, 144 R, 274; 244/79

[56] References Cited

U.S. PATENT DOCUMENTS

| | | | |
|---|---|---|---|
| 769,693 | 9/1904 | Forbes . | |
| 796,893 | 8/1905 | Brennan | 114/122 |
| 1,093,159 | 4/1914 | Thomson . | |
| 1,112,997 | 10/1914 | Ferranti . | |
| 1,134,439 | 4/1915 | Chessin . | |
| 1,150,311 | 8/1915 | Sperry | 114/122 |
| 1,186,856 | 6/1916 | Sperry | 114/122 |
| 1,800,408 | 4/1931 | Schein | 114/126 |
| 2,590,207 | 3/1952 | Ramsay | 74/5.8 |
| 2,874,576 | 2/1959 | Barnes | 74/5.1 |
| 3,373,832 | 3/1968 | Summers | 180/30 |
| 3,410,357 | 11/1968 | Summers | 180/30 |
| 3,463,109 | 8/1969 | Weiler | 114/286 |
| 3,576,134 | 4/1971 | Fersht | 74/5.22 |
| 4,261,478 | 4/1981 | Gaudin | 114/286 |
| 5,413,010 | 5/1995 | Nakanishi | 74/5.22 |

FOREIGN PATENT DOCUMENTS

| | | | |
|---|---|---|---|
| 8760 | 6/1915 | United Kingdom | 114/122 |

OTHER PUBLICATIONS

Pp. 284–290 of "The Navy, Engineering Applications of the Gyroscope", by Elmer A. Sperry Jul. 1913.

*Primary Examiner*—Ed L. Swinehart
*Attorney, Agent, or Firm*—Alvin S. Blum

[57] ABSTRACT

A water craft or land vehicle is stabilized against rolling and pitching forces by a mass or masses rotating about a vertical axis. The mass or masses are distributed along the vertical axis so that the center of the overall mass lies on the roll and pitch axes so that resistance to roll and pitch is exerted without precession. The gyro is gimballed along two axes which coincide with the roll and pitch axes. A stop mechanism allows a free pitching and rolling through a small angle before gyro resistance is met. Hydrofoils may be extended and retracted under pitch and roll signals from the gyro for extra stability.

4 Claims, 2 Drawing Sheets

VEHICLE STABILIZING BY ROTATING MASS

FIELD OF THE INVENTION

This invention relates to water and land vehicles and more particularly to means for stabilizing them against pitching and rolling including the inherent stabilizing action of a heavy mass rotating vertically at high speed.

BACKGROUND OF THE INVENTION

Stabilization of ships has been the subject of diverse patents both for security of passengers and cargo in heavy seas and for warships to enhance the accuracy of their artillery. In active stabilizers, a gyroscope is used as a sensor of ship position for actuating a powered means of righting the vessel or of countering the rolling or pitching action of the sea such as by deploying hydrodynamic planes or fins or by pumping ballast about.

Passive gyroscopic systems use a massive rotating disc or cylinder which resists disturbances of its axis of rotation by precession. When the axis of rotation is vertical, any rolling motion of the vessel is converted to a more acceptable pitching motion. Conversely pitching motion is converted to rolling motion.

It would be desirable to have a simple and reliable vehicle stabilizing means that would resist both rolling and pitching without converting it to other unwanted motion.

High speed boats that rise up to plane with the hull at least partly out of the water are vulnerable to rolling over and capsizing, especially in a sharp turn. Boats with hydrofoils beneath the hull are especially vulnerable to roll over because their center of gravity is high above the water. Some water craft of this type are limited to a turn of only 5 degrees when being propelled at speeds of 125 miles per hour.

It would be desirable to have a mechanism associated with the hydrofoils that would enable the hydrofoils to retract when not in use. It would also be useful if the hydrofoil retracting mechanism could be employed to further stabilize the vessel in turns at high speed by an active gyroscopic mechanism.

SUMMARY OF THE INVENTION

It is accordingly an object of the invention to provide a passive stabilizing means for land and water vehicles that employs a rapidly rotating substantial mass rotating about a substantially vertical axis that resists pitching action on the vehicle without converting it to rolling motion and that resists rolling motion of the vehicle without converting it to pitching motion. The inertia of the rotating mass resists changing its axis of rotation without converting it to rolling motion and that resists rolling motion of the vehicle without converting it to pitching motion. The inertia of the rotating mass resists changing its axis of rotation without the precessional action of a conventional gyroscope.

The pitching and rolling forces exerted on the supports of the rotating mass may be sensed for actuating other optional stabilizing functions as well.

For example, a vessel may be equipped with retractable hydrofoils or pontoons. These may be adjusted in response to signals from those sensors to trim the vessel in turns and heavy seas by an active gyroscope mechanism.

A vehicle body that is to be stabilized against rolling about a horizontal longitudinal axis and also against pitching about a horizontal transverse axis, mounts the gyro stabilizer of the invention to rotate about a vertical axis that substantially intersects both roll and pitch axes. The rotating mass is extended along its axis of rotation and its center of mass is positioned at, or close to, the pitch and roll axes to achieve stabilization without precession.

These and other objects, features and advantages will become apparent when the detailed description is considered in conjunction with the drawings in which like reference characters refer to like elements in the various figures.

DETAILED DESCRIPTION OF PREFERRED EMBODIMENTS

Figures 1, 2, 3:
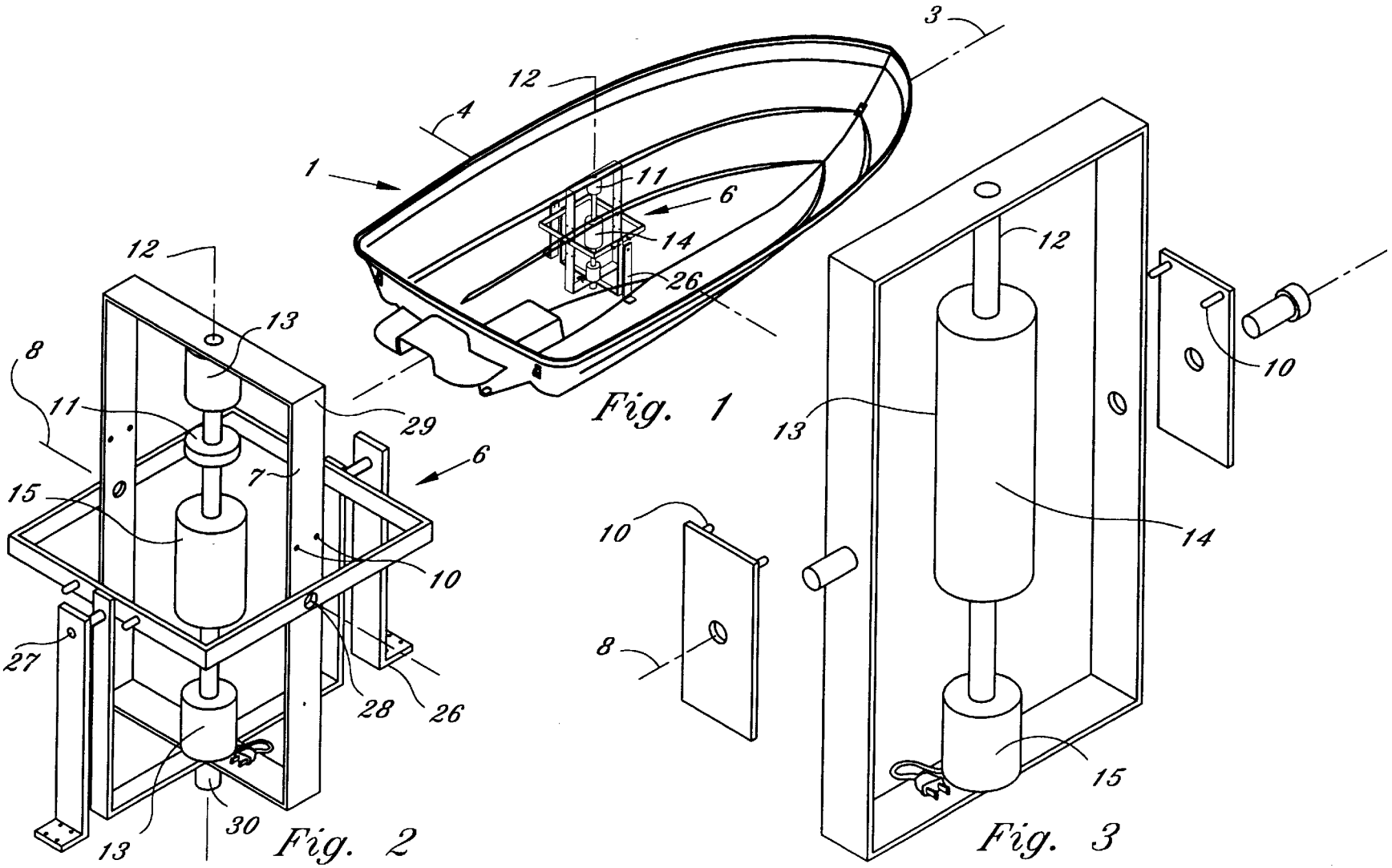
FIG. 1 is a perspective view of a boat with the stabilizer of the invention in place.
FIG. 2 is a perspective view of the stabilizer of FIG. 1.
FIG. 3 is another embodiment of the invention in perspective view.
Figure 5:
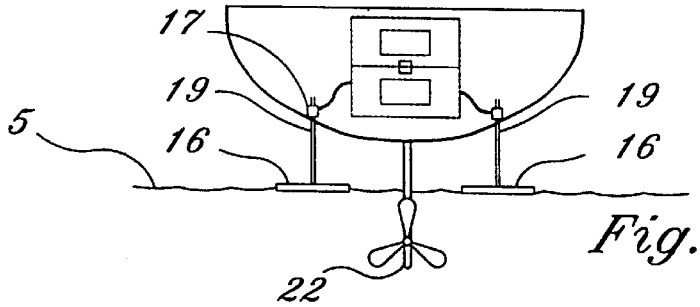
FIG. 5 is a diagrammatic end view of a hydrofoil boat of the invention.
Figure 6:
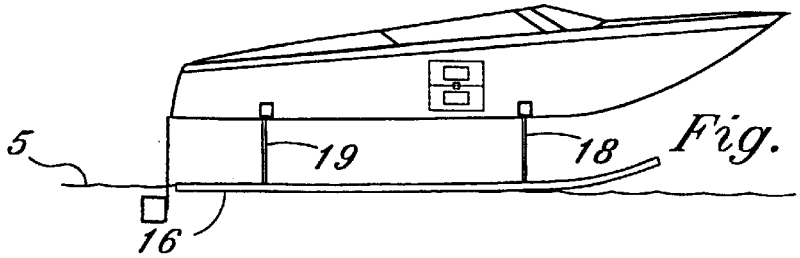
FIG. 6 is a diagrammatic side view of the boat of FIG. 5.
Figure 7:
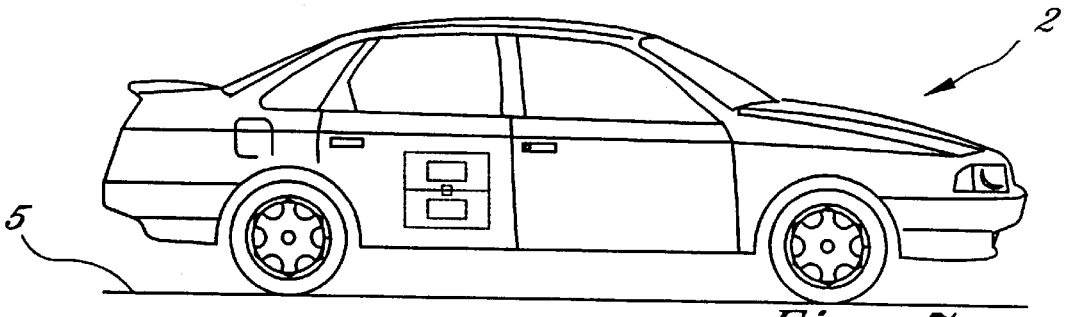
FIG. 7 is a diagrammatic side view of a land vehicle of the invention.

The invention may be used to stabilize vehicles that operate on a surface 5 that may be water such as a boat or ship 1 or other water craft including displacement hulls, planing hulls, catamarans, hydrofoil boats and the like, as shown in FIGS. 1,5,6 for example. Alternatively, the invention may be used to stabilize vehicles that operate on a solid supporting surface 5 such as the automobile 2 shown in FIG. 7.

Referring now to FIGS. 1, and 2, a boat 1, is provided with a gyroscopic or gyro stabilizing apparatus 6 mounted to the boat hull by sturdy uprights 26. A two axis gimbal gyro frame 7 pivots about a horizontal longitudinal roll first axis 8 and a horizontal transverse athuart or pitch second axis 9. The pivots on the second axis 9 may be on ball bearings 27 mounted in the uprights 26. The pivots on the first axis 8 may be on ball bearings 28.

An inner rectangular member 29 supports a gyro rotor assembly 11 comprising a rotatably mounted vertical rotor shaft 11 rotating about a vertical rotor axis 12 driven by a rotary mass driver motor 15 at high speed, and two cylindrical masses 13 having a total weight as much as 10% of the total water craft weight securely attached to the shaft to provide gyroscopic action.

The boat 1, because of the hull shape and mass distribution, has a propensity to roll about a horizontal, longitudinal roll axis 3, and to pitch about a horizontal transverse pitch axis 4.

The longitudinal roll axis 3 is parallel to the direction of major travel of the vehicle and the pitch axis is athwart or transverse to the roll axis.

The stabilizing apparatus 6 is mounted in the boat 1 so that the first axis 8 is aligned substantially with the roll axis 3, and the second axis 9 is aligned substantially with the pitch axis 4.

An extra weight 30 at the bottom of the inner rectangular member 29 causes the assembly to act like a pendulum with maximum effect when the rotor is not turning. This ensures that the gyro will always have a vertical axis when it is activated. That is, it will be aligned with a gravitational vertical when power is applied to it. When the gyro is running, there will always be a small force to return the rotational axis to the vertical after any disturbance requiring it to exert any force.

The rotor will remain vertical with small degrees of roll and pitch through gimbal action so that a smooth ride is obtained.

The stops 10 limits the angle of rotation of the gimbal pivot. When the roll angle rotates the inner member 29 beyond that angle, the pivoting inner member will strike one or the other of the stops 10, and further rolling causes the gyro to exert a force to resist any further rolling of the vessel. The center of mass 14 of the the rotating mass or masses 13 is designed to lie on the roll axis 3 or very close to it.

The same mechanism is provided with stops 10 on the second axis directed to pitch forces of rotation about the pitch axis 4.

Figure 4:
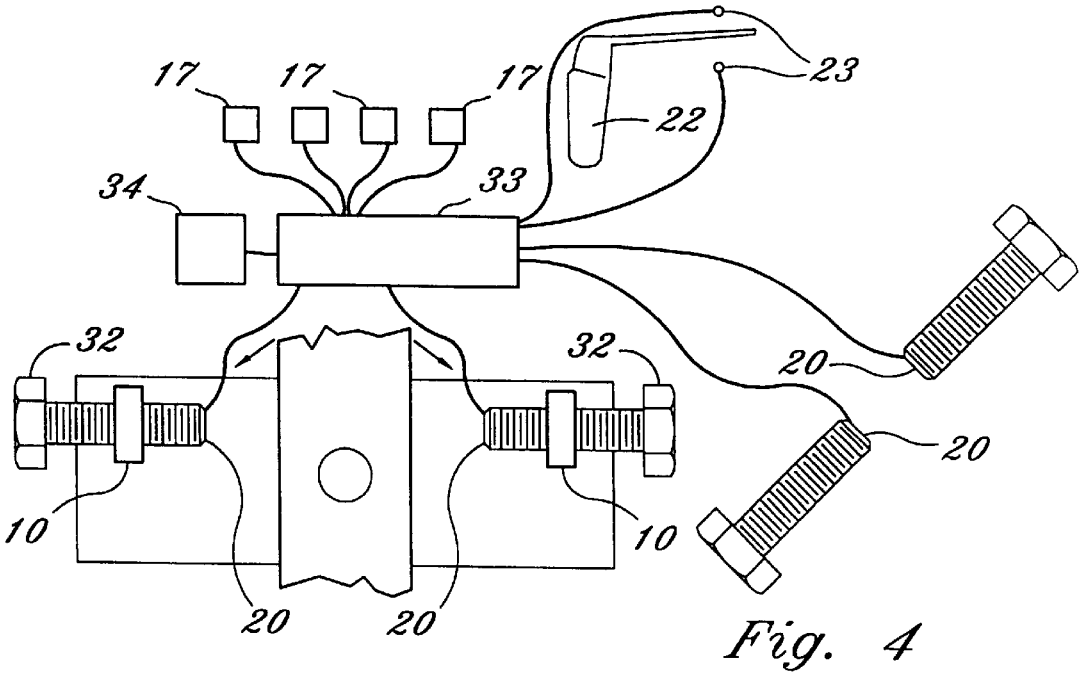
FIG. 4 is a diagrammatic illustration of the angle stop and sensing mechanism of the invention.

FIG. 4 shows how the stop devices 10 may be made adjustable with threaded bolts 32. Sensors 20, on the tips of bolts 32, may provide a signal when rotation of the vehicle causes contact with a stop 10.

These signals may be used in an active gyroscopic stabilizing mechanism applicable to the hydrofoil, pontoon or catamaran type craft shown in FIGS. 5 and 6. The elongated hydrofoils 16 are aligned parallel to the centerline and on both sides thereof. Each is supported by a fore support 18 and an aft support 19. A power drive 17 electromechanically, or by other means, raises or lowers each support under a control mechanism shown in FIG. 4.

Each sensor 20 is wired to a microprocessor 33, two for the first axis and two for the second axis. Also a manual control 34 is connected to the microprocessor. The hydrofoils will be retracted, or adjusted, until a certain speed is reached based on conditions. Then under manual or computer control, the hydrofoils are extended and the planing hull is elevated above the water surface far enough so that the vessel can perform like a catamaran. Now pitch and roll beyond the preset angles may result in selective retraction or extension of the hydrofoils to trim the craft by fore and aft trimming such as by raising or lowering both fore or both aft supports, and by retracting both fore and aft supports for one of the hydrofoils to tilt the craft to one side. This is especially useful in turning at high speed where the hydrofoils on the inside of the turn is retracted to effectively "bank" in the turn. This mechanism may be further enhanced by banking at the start of the turn using turn sensing or rudder sensors 23 adapted to provide a turn signal to the microprocessor 33 when rudder 22 is turned. This results in retracting the hydrofoil on the inside of the turn when the rudder is turned beyond a preset angle.

FIG. 3 illustrates an elongated single cylindrical mass 13 extending along the vertical rotating axis 12 with a center of mass 14 lying at a first axis 8. The rotary motor 15 serves as a pendulum weight, serving as a centering or centralizing mechanism for the gyroscope.

The above disclosed invention has a number of particular features which should preferably be employed in combination although each is useful separately without departure from the scope of the invention. While I have shown and described the preferred embodiments of my invention, it will be understood that the invention may be embodied otherwise then as herein specifically illustrated or described, and that certain changes in the form and arrangement of parts and the specific manner of practicing the invention may be made within the underlying idea or principles of the invention.

What is claimed is:

1. In a vehicle having a propensity to roll about a horizontal, longitudinal roll axis extending along the direction of travel and to pitch about a horizontal pitch axis transverse to the roll axis, a stabilizing apparatus comprising:

a gyro frame assembly mounted on the vehicle for rotation about a horizontal longitudinal, roll first axis and for rotation about a horizontal transverse pitch second axis;

independently adjustable first stop means operatively connected to the gyro frame assembly for preset limiting of the amount of rotation about the first axis independent of rotation about the second axis;

independently adjustable second stop means operatively connected to the gyro frame assembly for preset limiting of the amount of rotation about the second axis independent of rotation about the first axis;

a gyro rotor assembly rotatably mounted on the gyro frame assembly for rotation about a vertical rotor axis;

the gyro rotor assembly having a rotary mass distributed along the rotor axis such that the center of the rotary mass lies substantially on the first and second axes;

means for driving the rotary mass at gyroscopic rotational velocities; and wherein the gyro rotor assembly resists torque on the vehicle about the roll axis and the pitch axis that exceeds the amount of rotation about the first and second axes preset by the stop means without substantial precession.

2. The apparatus according to claim 1, in which the rotary mass is comprised of two masses separated from one another by a rotary mass driving means for driving both masses.

3. The apparatus according to claim 1 further comprising a pendulous centering means attached to a lower portion of the rotor assembly, the centering means for establishing a gravitationally vertical position of the rotor assembly.

4. The apparatus according to claim 3, in which the rotary mass is comprised of two masses separated from one another by a rotary mass driving means for driving both masses in the same direction.

* * * * *